United States Patent [19]

Fallas

[11] Patent Number: 4,864,801

[45] Date of Patent: Sep. 12, 1989

[54] AUTOMATIC CASE PACKING APPARATUS

[76] Inventor: David M. Fallas, 7000 Imperial Dr., Waco, Tex. 76702-0354

[21] Appl. No.: 175,414

[22] Filed: Mar. 30, 1988

[51] Int. Cl.[4] ..... B65B 35/40; B65B 35/50; B65B 35/56; B65B 39/02

[52] U.S. Cl. ..... 53/446; 53/448; 53/473; 53/247; 53/258; 53/540; 53/542; 53/543; 53/544

[58] Field of Search ..... 53/543, 539, 542, 473, 53/446, 544, 247, 261, 448, 540, 258

[56] References Cited

U.S. PATENT DOCUMENTS 4,398,383 8/1983 Prakken ..... 53/543 X
4,583,351 4/1986 Fallas ..... 53/542 X
4,660,352 4/1987 Deines et al. ..... 53/543 X
4,768,328 9/1988 Mims ..... 53/542 X

*Primary Examiner*—Horace M. Culver
*Attorney, Agent, or Firm*—Arnold, White & Durkee

[57] ABSTRACT

An apparatus for automatically collecting and packing a selected number of units of product in flexible bags into a carton in a vertical orientation. The apparatus includes a collecting assembly for receiving and positioning a row of such units in an inclined position. An assembly is provided to transport the inclined row of units from the collecting assembly to a loading station. The loading station is operable to raise one or more rows transported thereto from their inclined position to a substantially vertical position, then plunge the vertically positioned units into a carton. A controller is provided for synchronizing the relative operation of the apparatus.

6 Claims, 3 Drawing Sheets

AUTOMATIC CASE PACKING APPARATUS

BACKGROUND OF THE INVENTION

The invention relates generally to devices for handling flexible bagged products such as potato chips, and more particularly it concerns an improved apparatus for automatically packing flexible bagged products such as potato chips into a carbon or case for handling.

The efficient handling of bags of breakable product such as potato chips or corn chips has long been a problem to the makers of such products. To assist such handling, there has been developed a collating unit for bagged products and the like which is the subject of my U.S. Pat. No. 4,356,906. This patent is incorporated herein by reference for the purpose of setting forth a suitable apparatus for supplying collated product and units to a packing apparatus.

While the provision of a machine which can collate and collect flexible bagged products is believed to be a significant development in the handling of such products, there still exists the need to collect and move a selected number of rows of such product into a carton or box. An example of one approach of automatically collecting and packing a selected number of such bags is disclosed in my U.S. Pat. No. 4,583,351. This patent is also incorporated herein by reference. This patent automatically collects a row of units of product in a vertical orientation and holds the row of products in the vertical orientation during handling through the use of opposing side belts comprised of high surface friction material.

While the provision of a machine which can move product in a vertical orientation from the place of collation to packing cases is believed to be a significant improvement, the side belts and related mechanism of the device require periodic maintenance and adjustment. It is therefore desirable to provide an apparatus which automatically collects and loads flexible bagged products into cartons in a vertical orientation having lower maintenance and adjustment requirements. The device should further be able to load a selected number of rows of such product into a carton without damage to the product.

SUMMARY OF THE INVENTION

The present invention provides such an apparatus for automatically collecting and packing a selected number of units of products in flexible bags into a carton in vertical orientation. The apparatus is particularly adapted for use in situations wherein units of product are supplied to the apparatus with a supply means such as the collator described in my U.S. Pat. No. 4,356,906, wherein the product is flipped from a horizontal orientation through a vertical position to an opposing horizontal position (if allowed to continue through). As will become apparent from the description below, such a collator allows a staggered, stacked collection of flexible bagged products which may be easily moved to a vertical orientation through the use of inclined and movable surfaces when desired.

More specifically, the present invention describes an apparatus for automatically collecting and packing a selected number of units of product in flexible bags into a carton in vertical orientation, wherein the product is supplied to the apparatus in units one at a time. The apparatus includes a collecting assembly comprising a means for collecting a row of a selected number of such units. The collecting means includes a means for receiving and conveying such units, an angled positioning member operatively associated with the conveying means for positioning the row of units in an inclined position on the conveying means, and a detection means for detecting the arrival of each such unit of product to the conveying means. In a preferred embodiment of the present invention, the collecting assembly of the apparatus of the present invention further includes a collating means for supplying a succession of horizontally oriented flexible bagged products and for flipping the bagged products upward and forward through a substantially vertical orientation onto the conveying means.

The apparatus further includes a means for transporting such an inclined row of product from the collecting assembly to a loading station. The loading station includes a door which acts as a floor for the loading station. The door is adapted to pivot between a vertical open position and a horizontal closed position. The loading station further includes a pivot member substantially aligned with the angled positioning member. The pivot member is adapted to support a selected number of inclined rows of units and is further adapted for movement to selectively raise the rows of units to a substantially vertical position. The loading station also includes a back alignment member opposing the pivot member, wherein the alignment member is adapted to substantially vertically align the rows of units in cooperation with the pivot member. The alignment member may be horizontally movable towards the pivot member to facilitate such vertical alignment.

The loading station further includes a plunger means for pushing the vertically positioned units into a carton. In a preferred embodiment, the plunger means includes a flap adapted to pivot between a horizontal plunging position and a vertical aligning position, and a transfer plate adapted to pivot between a horizontal transporting position and a vertical loading position.

The apparatus still further includes a controller means operatively associated with the conveying means, the detection means, the transporting means, and the plunger means for controlling the sequential operation of each of these means. The controller may be, for example, a single microprocessor programmable controller unit having standard input/output units to receive and process electrical signals from the detection means. In particular, the controller provides a means for indexing the conveying means forward as each unit of product is received by the conveying means. In doing this, the controlling means indexes the conveying means a selected distance so that the units stack on top of one another (or lean against each other) in a staggered relationship.

Once a selected number of units as counted by the controller means is collected to form a row on the conveying means, the controller provides a means for actuating the conveying means to advance the row of units to the angled positioning member for positioning of the units in an inclined position. The controller also provides a means for selectively actuating the transporting means to transport an inclined row of units on the angled positioning member to the loading station.

Once a selected number of inclined rows of units as counted by the controller means are transported to the loading station, the controller then provides a means for selectively actuating the pivot member to raise the units to a substantially vertical position, for selectively actuating the door from a horizontal closed position to a vertical open position, and for selectively moving the plunger means to push the vertically positioned units into a carton. After the units are in the carton, the controller then provides a means for selectively withdrawing the plunger means when desired.

In a preferred embodiment, the plunger means is not withdrawn until after the first row of the next set of rows of units to be packaged is transported to the loading station. In this embodiment, the plunger means includes a pivotable flap as described above. Before the plunger means is withdrawn, the controller means actuates the flap to pivot to its vertical aligning position. The first row of the next set is then transported to the loading station and aligned by the flap. The plunger means is then withdrawn. Thus in this embodiment, the plunger means also serves as a means for aligning the first such row so transported.

Alternatively, this aligning function can be provided by programming the controller means to move the transporting means a selected distance corresponding to which row is being transported to the loading station. For example, the first row of each set could be moved all the way across the door of the loading station, the second row moved only a part of that distance to abut the first row, and so on. It is believed that the first embodiment is less expensive to design and build.

Accordingly, the present invention provides an apparatus for automatically collecting and packing a selected number of units of vertically orientated bagged products into a carton. The apparatus provides a means for collecting such product without side belts requiring maintenance or other complex machinery.

Thus, in a broad aspect the invention comprises a system in which items such as bags of potato chips are received one-by-one in a linear, inclined array in a collecting zone or station. The array is then readied for packing in a container by moving each bag into an upright position and assembling the entire array over a trap door, a pair of bomb bay doors or the like. Finally, the door is opened and the array is dropped or pushed into a suitable container.

The system of the invention is especially suited for situations in which items must be packaged in more than one row in a container. In this instance the individual items, especially items such as bags of potato chips, are first assembled in a linear, inclined array in a collecting zone in which the number of items in the array is the same as the number in a row in the box. This array is then moved laterally to a loading station or zone where it rests on a trap door or the like. As this initial array is moved to the loading station, a removable vertical baffle or the like at the loading station preferably keeps the arry in linear form. Meanwhile, a second, inclined linear array of bags or the like is received and assembled at the collecting station. This array is then straightened up and moved alongside the initial array in the loading station and over the trap door. This process is repeated until the number or arrays in the loading station is the same as the number of rows to be placed in the container. At this point, the trap door is opened and all the arrays are dropped, pushed or otherwise moved into the container.

As noted earlier, the system of the invention is especially applicable to packing bags of food chips which are typically fragile and difficult to pack without breakage. In handling such bags at the collecting station, the bags will normally be received one after the other in horizontal disposition with the bottom of each bag leading the way. Each bag will then be pivoted around its bottom and deposited on a belt which moves stepwise. The first bag in each linear array will lie on the belt with the top of the bag facing downstream toward an end plate or ramp which is inclined away from the top of the bag. With each successive step of the belt, another bag will be deposited on the belt such that it will rest on the next preceding bag in a leaning position. When a complete array has been so deposited, the belt will then advance the entire array against the end plate or ramp such that all of the bags in the array are either inclined or vertical, but preferably inclined. This array is then pushed or otherwise moved on to the trap door of a loading station where it is preferably kept in its linear array form.

This sequence of events is repeated until enough arrays are present at the loading station to supply all of the rows needed in a shipping box or similar container. If the arrays are still inclined at this point, they are first pushed into a vertical position and then deposited in the container. A preferred pushing device, as noted earlier, is a plate which spans all of the bags but preferably is capable of entering the container.

BRIEF DESCRIPTION OF THE DRAWINGS

This invention will further be illustrated by reference to the appended drawings which illustrate a particular embodiment of the device for automatically collecting and packing a selected number of units of flexible bagged product in a vertical orientation into a carton in accordance with the invention.

DESCRIPTION OF THE PREFERRED EMBODIMENT

It will be understood that the present invention can be implemented in a number of different ways, within the spirit and scope of the claims appended hereto. The presently preferred embodiment of the invention will now be described.

Figure 1:
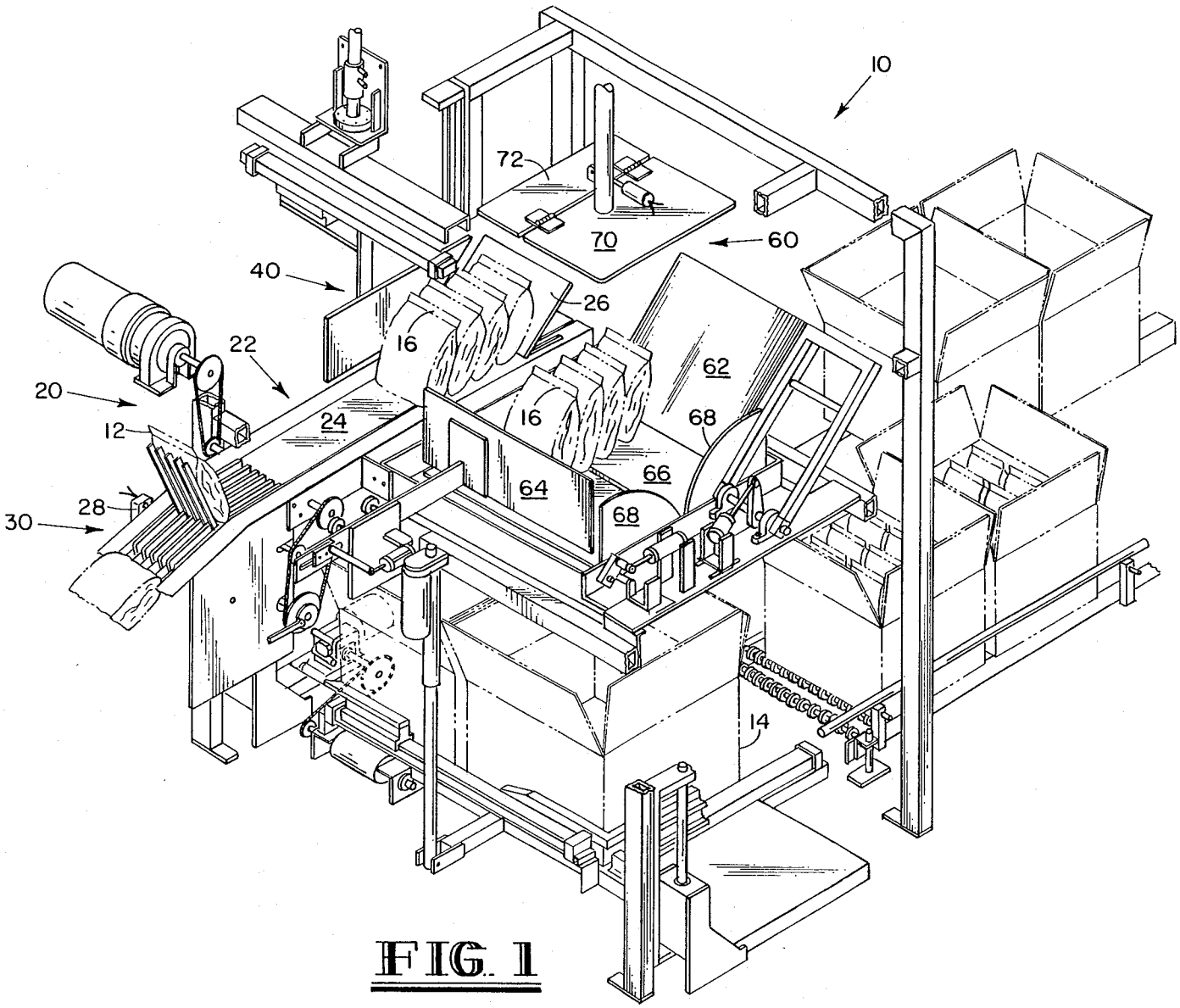
FIG. 1 is an isometric view of the present invention having selected structural members cut away to accommodate illustration of the pertinent features.

Referring now to FIG. 1, the present invention provides an apparatus generally represented by a frame 10 which is adapted to support a collecting assembly 20, a transporting means 40, a loading station 60, and a controller means (not shown).

The apparatus is provided according to the present invention for automatically collecting and packing a selected number of units 12 of product in flexible bags into a carbon or box 14, the units being packed into the box in a vertical orientation. The product is supplied to the apparatus in units 12, one at a time.

The collecting assembly 20 includes a means 22 for collecting a row 16 of a selected number of units 12. In the preferred embodiment, the collecting assembly 20 further includes a collator 30 for supplying a succession of horizontally oriented units 12 of flexible bagged products and for flipping the units 12 upward and forward through a substantially vertical orientation to the collecting means 22.

The collecting means 22 includes a product conveyor belt 24 for receiving and conveying such units 12. The collecting means 22 further includes an angled positioning member 26 operatively associated with the product belt 24 for positioning a row 16 of units 12 in an inclined position on the product belt 24. The collecting means 22 also includes an optical or photoelectric detection mechanism 28 for detecting the arrival of each such unit 12 of product onto the product belt 24.

The apparatus further includes a cross pusher 40 for transporting such an inclined row 16 of units 12 from the collecting assembly 20 to a loading station 60. The cross pusher 40 moves horizontally and transversely to the product belt 24 to push the row 16 of units 12 to the loading station 60. Before returning to its original position, the cross pusher 40 may be moved vertically upwards in order to clear the next row of units being collected on the product belt 24. After the cross pusher is returned horizontally above the next such row, it is lowered to its original position to push the next row of units at the appropriate time.

The loading station 60 includes a pivot member 62 substantially aligned with the angled positioning member 26 and adapted to support a selected number of inclined rows 16 of units 12. The pivot member 62 is further adapted for movement to selectively raise the rows 16 of units 12 to a substantially vertical position. The loading station 60 also includes a back alignment member 64 opposing the pivot member 62. The alignment member 64 is adapted to substantially vertically align the rows 16 of units 12 in cooperation with the pivot member 62. The alignment member 64 may be horizontally movable towards the pivot member 62 during vertical alignment of the units 12.

The loading station 60 further includes a door 66 adapted to pivot between a vertical open position and a horizontal closed position. In the horizontal closed position, the door 66 acts as a floor for the loading station 60. In the preferred embodiment, the door 66 consists of two bomb bays as shown.

The loading station may also include a transfer plate 74 (as most clearly seen in FIG. 2I) located between the product belt 24 and door 66. The transfer plate is pivotable from a horizontal transporting position to a vertical loading position. After a selected number of rows to be loaded into a box has been transported to the loading station, the transfer plate 74 is pivoted in the direction indicated on FIG. 2I to its vertical position, thereby assuring that the last row of units transported is properly aligned over the door 66 for loading.

The loading station 60 further includes a plunger 70 for pushing the vertically positioned units 12 into a carton or box 14 located beneath the door 66. Preferably the plunger 70 includes a flap 72 adapted to pivot between a horizontal plunging position and a vertical aligning position.

The apparatus further includes a logic controller (not shown) operatively associated with the conveying means 24, the detection means 28, the transporting means 40, and the plunger means 70 for controlling the sequential operation of each of these means. In particular, the controller provides a means for indexing the product belt 24 forward as each unit 12 of product is received by the product belt 24, the controller indexing the product belt 24 a selected distance so that the units 16 stack on top of one another in a staggered relationship.

The controller counts the number of units 12 received by the product belt 24. Once a selected number of units 12 is collected to form a row 16, the controller provides a means for actuating the product belt 24 to advance the row 16 of units 12 to the angled positioning member 26 for positioning of the units 12 in an inclined position. The controller also provides a means for selectively actuating the cross pusher 40 to transport an inclined row 16 of units 12 to the loading station 60.

Once a selected number of inclined row 16 of units 12 are transported to the loading station 60, the controller then provides a means for selectively actuating the pivot member 62 to raise the units to a substantially vertical position, for selectively actuating the door 66 from a horizontal closed position to a vertical open position, and for selectively moving the plunger 70 to push the vertical units 12 into a carton 14.

After the units are in the carton 14, the controller then provides a means for selectively actuating the flap 72 to pivot from its horizontal plunging position to its vertical aligning position. The plunger 70 is preferably not withdrawn until after the first row of the next set of rows 16 of units 12 to be packaged is transported to the loading station 60. The flap 72 thus serves as a means for aligning the first such row 16 so transported. After such first row has been transported to the loading station 60 and aligned by the flap 72, the controller then provides means for selectively withdrawing the plunger 70 when desired.

Figure 2A:
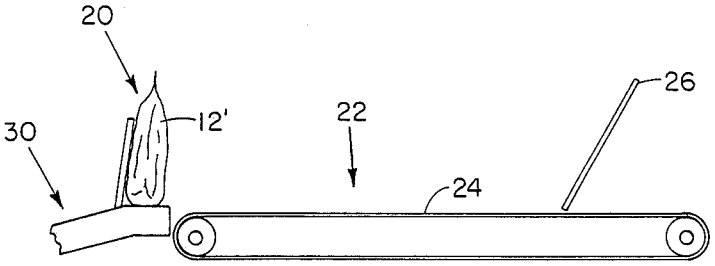
FIGS. 2A–2E illustrate the supply and collection of a row of bagged products on the conveying means of the present invention.

In operation, units 12 are supplied to the apparatus one at a time, for example, by a horizontal conveyor belt (not shown) aligned with the collecting assembly 20. The collator 30 supplies a succession of horizontally oriented units 12 to the product belt 24 by flipping the units 12 upward and forward through a substantially vertical position onto the product belt 24, as shown in FIG. 2A.

Referring to FIGS. 2A–2E in connection with FIG. 1, the collecting means 22 receives the first unit 12' onto the product belt 24 where the unit lies substantially horizontally. The detector 28 detects the arrival of such first unit 12', and the controller reacts by indexing the product belt 24 forward a selected distance, for example, the approximate width of a unit 12.

Figure 2B:
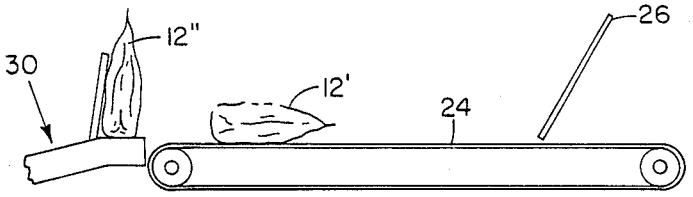
Figure 2C:
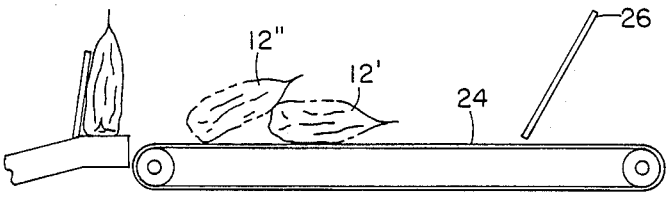
Figure 2D:
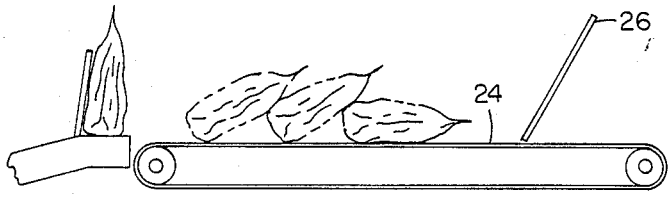
Figure 2E:
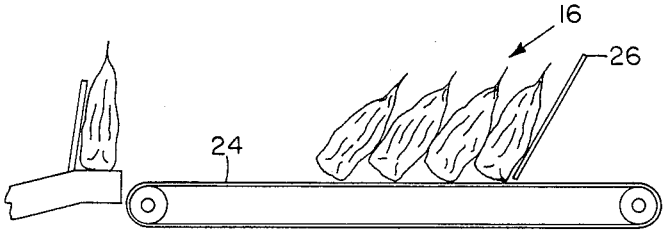

As shown in FIG. 2B, the collecting means 22 then receives the second unit 12" as it is flipped onto the product belt 24 by the collator 30. The second unit 12" is thereby stacked on top of the first unit 12' in a staggered relationship; that is, the second unit 12" leans on the first unit 12". The detector 28 detects the arrival of the second unit 12' and the controller again reacts by indexing the product belt 24 forward, as shown in FIG. 2C. This process continues (as shown in FIG. 2D) until a selected number of units (for example four as shown) as counted by the controller has been collected onto the product belt 24 to form a row 16. The controller then actuates the product belt 24 forward to advance the row 16 of units 12 to the angled positioning member 26, where the units 12 are oriented in an inclined position by sliding up and leaning on the angled positioning member 26, as shown in FIG. 2E.

Referring to FIGS. 2F–2J in connection with FIG. 1, the controller next actuates the cross pusher 40 to transport the inclined row 16 of units 12 onto the door 66 of the loading station 60. During transporting of the units from the product belt, the door 66 is in its horizontal closed position.

Figure 2F:
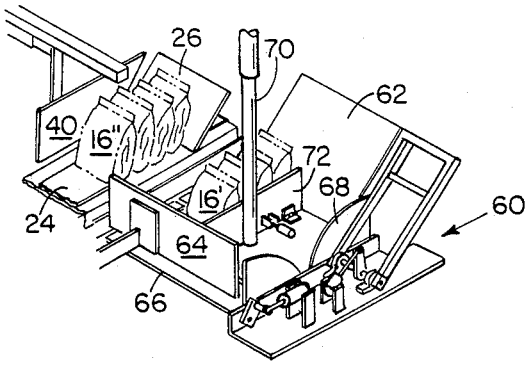
FIGS. 2F–2H illustrate the transportation of a selected number of rows and the collection of sequential rows of flexible bagged product in the loading station.

Referring particularly to FIG. 2F, the plunger 70 at this stage is in its down position, and the flap 72 is in its vertical aligning position. In this manner, the cross pusher 40 transports the first row 16' of units against the flap 72, the flap 72 aligning the first row 16' of units. After the first row 16' has been transported and aligned, the controller then actuates the plunger 70 up so that subsequent rows may be received into the loading station 60, and actuates the flap 72 down to its horizontal plunging position. It is noted that in the embodiment shown in FIG. 2F, the second row 16" has been collected and readied for transport prior to withdrawal of the plunger. However, it should be appreciated that the plunger could be withdrawn prir to or during the collection of the second row 16", and such detals are a matter of design choice in programming the controller.

Figure 2G:
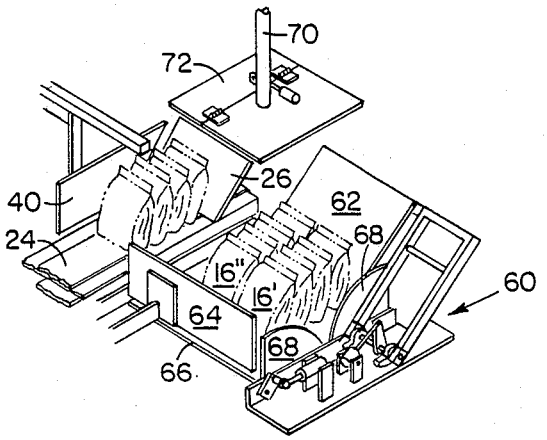

Referring particularly to FIG. 2G, after the first row 16' has been transported to the loading station 60 and a second row 16" has been collected on the product belt 24 and positioned on the angled positioning member 26, the controller again actuates the cross pusher 40 the transport the second row 16" of units 12 to the loading station 60. The second row 16" pushes the first row 16' as it is transported to the loading station 60.

Figure 2H:
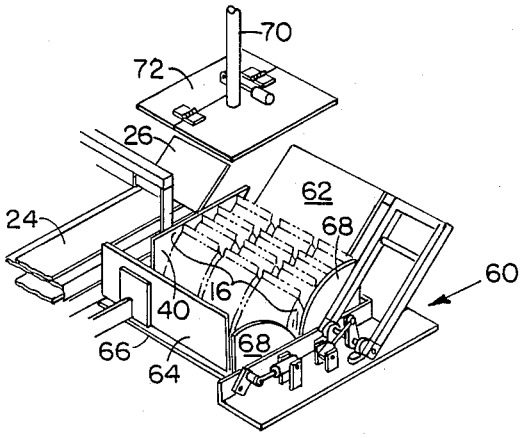

Referring to FIG. 2H, this process continues until a selected number of rows 16 (for example three as shown) as counted by the controller means is transported to the loading station 60. The bomb bays 66 preferably include vertical side walls 68, which function to align the first row 16' in position to be loaded into a carton. The loading station 60 may further include a vertical aligning member (not shown) interior to and adjacent the side walls 68 to assure that no units are pinched by the side walls 68 during loading.

Figure 2I:
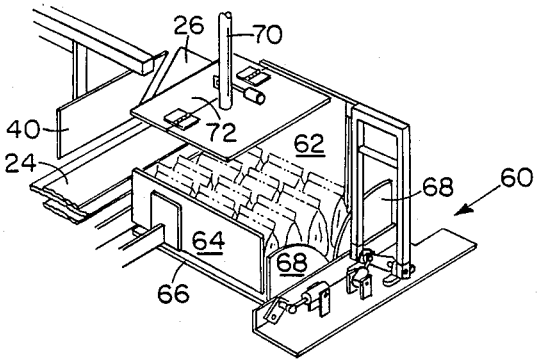
FIGS. 2I–2J illustrate the loading of the selected number of rows of bagged products having a vertical orientation into the supply box or carton.
Figure 2J:
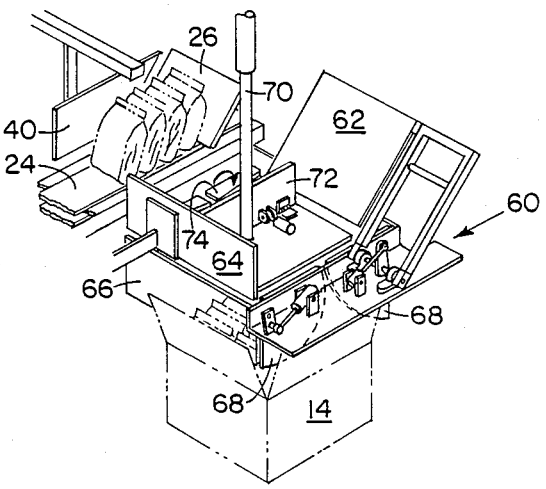

At this point, the controller actuates the transfer plate 74 (see FIG. 2J) to pivot to its vertical loading position, and also actuates the pivot member 62 to raise the units 12 to a substantially vertical position, as shown in FIG. 2I. Back alignment member 64 may cooperatively be moved horizontally towards the pivot member 62 at this point to further facilitate vertical alignment of the units. The controller then selectively actuates the door 66 from its horizontal closed position to its vertical open position, and selectively moves the plunger 70 to push the vertically positioned units 12 into the carton 14 located beneath the door 66, as shown in FIG. 2J. While the plunger 70 remains in its down position, the controller actuates the flap 72 to pivot to its vertical aligning position and the pivot member 62 to return to its position substantially aligned with the angled positioning member 26. The loading station 60 is then ready to receive the first row 16' of the next set of rows of units to be packaged.

The instant invention has been disclosed in connection with a specific embodiment. However, it will be apparent to those skilled in the art that variations from the illustrated embodiment may be undertaken without departing from the spirit and scope of the invention. For example, angled positioning member 26 might be pivotable to a vertical position and member 62 aligned in a stationary vertical position. In this manner, the units would be vertically aligned before being transported to the loading station. These and other variations will be apparent to those skilled in the art and are within the spirit and scope of the invention.

What is claimed is:

1. An apparatus for automatically collecting and packing a selected number of units of product in flexible bags into a carton in a vertical orientation, the product being supplied to the apparatus in units, one at a time, comprising:

(a) a collecting assembly including a means for collecting a row of a selected number of such units, the collecting means comprising:
  (i) means for receiving and conveying such units;
  (ii) an angled positioning member operatively associated with the conveying means for positioning the row of units in an inclined position on the conveying means; and
  (iii) detection means for detecting the arrival of each such unit to the conveying means;

(b) means for transporting such an inclined row of units of product from the collecting assembly to a loading station;

(c) a loading station including:
  (i) a pivot member substantially aligned with the angled positioning member and adapted to support a selected number of inclined rows of units, the pivot member being further adapted for movement to selectively raise the rows of units to a substantially vertical position;
  (ii) a back alignment member opposing the pivot member, the alignment member being adapted to substantially vertically align the rows of units in cooperation with the pivot member;
  (iii) a door adapted to pivot between a vertical open position and a horizontal closed position;
  (iv) plunger means for pushing the vertically positioned units through the open door into a carton; and (d) controller means operatively associated with the conveying means, the detection means, the transporting means, and the plunger means:
  (i) for indexing the conveying means forward a selected distance as each unit of product is received by the conveying means so that the units stack on top of one another in a staggered relationship;
  (ii) once a selected number of units as counted by the collector means is collected to form a row, for actuating the conveying means to advance the row of units to the angled positioning member for positioning of the units in an inclined position;
  (iii) for selectively actuating the transporting means to transport an inclined row of units to the loading station; and
  (iv) once a selected number of inclined rows of units as counted by the collector means is transported to the loading station, for selectively actuating the pivot member to raise the units to a substantially vertical position, for selectively actuating the door from its horizontal closed position to its vertical open position, for selectively moving the plunger means to push the vertically positioned units into a carton and, after the units are in the carton, for selectively withdrawing the plunger means.

2. The apparatus of claim 1, wherein the collecting assembly further comprises collating means for supplying a succession of horizontally oriented units of products in flexible bags and for flipping such units upward and forward through a substantially vertical orientation onto the conveying means.

3. The apparatus of claim 1, wherein the plunger means includes a flap adapted to pivot between a horizontal plunging position and a vertical aligning position, the controller means being further operative for selectively actuating the flap to its vertical aligning position after the plunger means has been moved to push the vertically positioned units into a carton but before the plunger means has been withdrawn, thereby providing a means for aligning a first row of units to be transported to the loading station.

4. A method of packing bags of potato chips or the like in a shipping container, comprising:

(a) advancing a conveyor belt in steps in a first longitudinal direction, depositing a bag of chips or the like on the belt at each step such that the tops of the bags face toward the first direction and each bag leans against the next preceding bag to form a linear row of bags;

(b) forcing the bags together a first time such that all of the bags are inclined in said first direction;

(c) moving the row of inclined bags from the conveyor belt to a covered opening over a shipping container, while maintaining said row of inclined bags;

(d) forcing the bags together a second time such that all of the bags are in a vertical disposition;

(e) opening the covered opening; and (f) pushing the row of vertically disposed bags through the opening into the container.

5. The method of claim 4 which further comprises:

repeating the sequence of steps (a) through (c) after step (c) to move a succeeding row of inclined bags for each repeated sequence alongside the preceding row of inclined bags on the covered opening; and thereafter performing steps (d) through (f) on all of the rows of bags during each such step.

6. Apparatus for packing rows of bags of potato chips or the like in a shipping container comprising:

(a) a conveyor belt indexed to move in increments in a first longitudinal direction, and adapted to receive a separate bag of chips during each incremental movement with the top of each bag facing in the first direction, and with each bag leaning against the next preceding bag to form a row of bags;

(b) an inclined member at the downstream end of said belt inclined in said first direction to incline a bag of chips upon movement of the bag against the inclined member;

(c) a trapdoor loading platform alongside one side of said conveyor belt, adapted to receive an open shipping container beneath the platform, and operable in an open trapdoor position to enable sufficient rows of bags of chips to be lowered into the container, to fill the container;

(d) a pivot plate pivotally mounted along its lower edge on said platform with said lower edge aligned with the bottom of said inclined member; said pivot plate capable of pivotal movement between a first inclined position in alignment with said inclined member and a second vertical position;

(e) a pusher member alongside the opposite side of said conveyor belt operable to push a row of bags of chips from the conveyor belt on to the trapdoor loading platform;

(f) a backplate movable mounted along a side of said platform across the platform from the pivot plate and movable toward and away from the pivot plate, said backplate adapted upon movement toward said pivot plate to compress bags of chips on the platform sufficiently to be passed through the platform in an open door condition; and (g) a horizontally disposed plunger mounted above said platform to move vertically between a first position spaced above the platform and a second position entering a container beneath the platform, said plunger adapted to push bags of chips through the platform in an open door condition upon movement of the plunger toward its said second position.

* * * * *